US009170544B2

(12) United States Patent
Yamashina et al.

(10) Patent No.: US 9,170,544 B2
(45) Date of Patent: Oct. 27, 2015

(54) IMAGE FORMING APPARATUS

(71) Applicants: Ryota Yamashina, Kanagawa (JP); Hiroshi Seo, Kanagawa (JP); Arinobu Yoshiura, Kanagawa (JP); Takumi Waida, Kanagawa (JP)

(72) Inventors: Ryota Yamashina, Kanagawa (JP); Hiroshi Seo, Kanagawa (JP); Arinobu Yoshiura, Kanagawa (JP); Takumi Waida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/470,096

(22) Filed: Aug. 27, 2014

(65) Prior Publication Data

US 2015/0071660 A1 Mar. 12, 2015

(30) Foreign Application Priority Data

Sep. 9, 2013 (JP) ..... 2013-185900

(51) Int. Cl.
*G03G 15/00* (2006.01)
*G03G 15/20* (2006.01)

(52) U.S. Cl.
CPC ..... *G03G 15/55* (2013.01); *G03G 15/5029* (2013.01); *G03G 15/2039* (2013.01); *G03G 15/502* (2013.01); *G03G 2215/00738* (2013.01)

(58) Field of Classification Search
None
See application file for complete search history.

(56) References Cited

U.S. PATENT DOCUMENTS

| | | | | |
|---|---|---|---|---|
| 6,996,349 | B2 * | 2/2006 | Ohta et al. | 399/45 |
| 2004/0033084 | A1 * | 2/2004 | Akizuki et al. | 399/69 |
| 2011/0222927 | A1 | 9/2011 | Yamashina | |

FOREIGN PATENT DOCUMENTS

| | | |
|---|---|---|
| JP | 10-160687 | 6/1998 |
| JP | 2006-062842 | 3/2006 |

OTHER PUBLICATIONS

U.S. Appl. No. 14/193,260, filed Feb. 28, 2014.
U.S. Appl. No. 14/473,448, filed Aug. 29, 2014.
U.S. Appl. No. 14/474,939, filed Sep. 2, 2014.

* cited by examiner

*Primary Examiner* — Clayton E Laballe
*Assistant Examiner* — Jas Sanghera
(74) *Attorney, Agent, or Firm* — Oblon, McClelland, Maier & Neustadt, L.L.P.

(57) ABSTRACT

An image forming apparatus for forming an image on each of recording media includes an optical sensor to irradiate each of the recording media with light to detect smoothness of each of the recording media according to a strength of specularly reflected light of the light with which each of the recording media is irradiated, and a processor to compare the smoothness of the recording media to determine whether a normal image can be formed on one of the recording media having a smoothness detected last.

7 Claims, 4 Drawing Sheets

IMAGE FORMING APPARATUS

CROSS-REFERENCE TO RELATED APPLICATION

This patent application is based on and claims priority pursuant to 35 U.S.C. §119(a) to Japanese Patent Application No. 2013-185900, filed on Sep. 9, 2013, in the Japan Patent Office, the entire disclosure of which is hereby incorporated by reference herein.

BACKGROUND

1. Technical Field

Embodiments of this disclosure generally relate to an image forming apparatus.

2. Related Art

Various types of electrophotographic image forming apparatuses are known, including copiers, printers, facsimile machines, or multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor serving as an image carrier. An optical writer irradiates the surface of the photoconductor thus charged with a light beam to form an electrostatic latent image on the surface of the photoconductor according to the image data. A development device supplies toner to the electrostatic latent image thus formed to render the electrostatic latent image visible as a toner image. The toner image is then transferred, directly or indirectly via an intermediate transfer belt, onto a recording medium. Finally, a fixing device applies heat and pressure to the recording medium carrying the toner image to fix the toner image onto the recording medium. Thus, the image is formed on the recording medium.

SUMMARY

In one embodiment of this disclosure, an improved image forming apparatus for forming an image on each of recording media is described that includes an optical sensor to irradiate each of the recording media with light to detect smoothness of each of the recording media according to a strength of specularly reflected light of the light with which each of the recording media is irradiated, and a processor to compare the smoothness of the recording media to determine whether a normal image can be formed on one of the recording media having a smoothness detected last.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
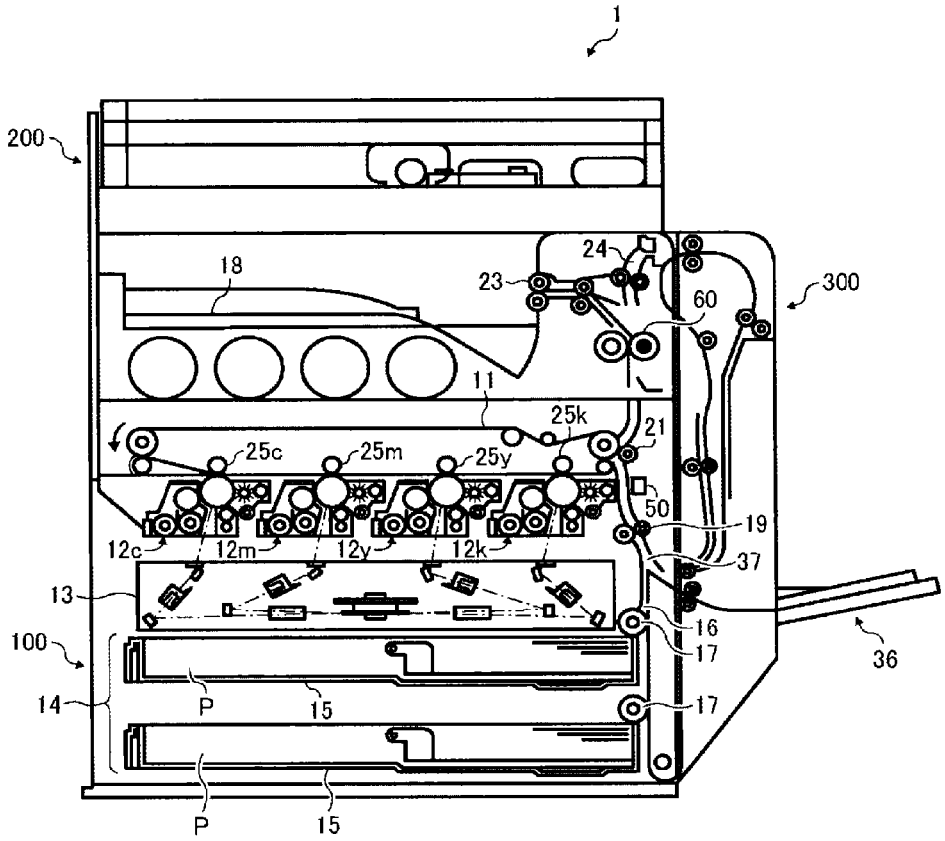
FIG. 1 is a schematic view of an image forming apparatus according to an embodiment of this disclosure.

The accompanying drawings are intended to depict embodiments of this disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and all of the components or elements described in the embodiments of this disclosure are not necessarily indispensable to the present invention.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

Referring now to the drawings, wherein like reference numerals designate identical or corresponding parts throughout the several views, embodiments of this disclosure are described below.

Initially with reference to FIG. 1, a description is given of a configuration of an image forming apparatus 1 according to an embodiment of this disclosure. It is to be noted that, in the following description, suffixes C, M, Y, and K denote colors cyan, magenta, yellow, and black, respectively.

FIG. 1 is a schematic view of the image forming apparatus 1. The image forming apparatus 1 of the present embodiment is an electrophotographic image forming apparatus. The image forming apparatus 1 includes a body 100, an image scanner 200, and a duplex unit 300.

The body 100 contains an intermediate transfer belt 11, imaging devices 12C, 12M, 12Y, and 12K, an exposure device 13, a feed unit 14, a conveyance passage 16, feed rollers 17, an internal discharge unit 18, and a discharge device 23. The body 100 further contains primary transfer devices 25C, 25M, 25Y, and 25K, an optical sensor 50, and a fixing device 60.

The intermediate transfer belt 11 is an endless belt made by seamlessly connecting both ends of a belt. The intermediate transfer belt 11 is stretched around a plurality of rollers disposed inside the body 100 almost horizontally. In addition, the intermediate transfer belt 11 travels in a counterclockwise direction in FIG. 1.

The imaging devices 12C, 12M, 12Y, and 12K are arranged side by side parallel to and below the intermediate transfer belt 11.

Each of the imaging devices 12C, 12M, 12Y, and 12K includes a drum-shaped image carrier rotated in a clockwise direction in FIG. 1 and various imaging components surrounding the image carrier, such as a charging device, a development device, a transfer device, and a cleaning device.

The exposure device 13 is disposed below the imaging devices 12C, 12M, 12Y, and 12K. The exposure device 13 irradiates the image carriers of the imaging devices 12C, 12M, 12Y, and 12K charged by the charging devices, respectively, to form latent images thereon according to image data of the respective colors of an original scanned by the image scanner 200.

The feed unit 14 is disposed below the exposure device 13. The feed unit 14 includes a plurality of trays 15 that load a stack of recording media P. According to the present embodiment, the feed unit 14 includes two trays 15 as illustrated in FIG. 1. However, the number of trays 15 is not limited thereto.

In the present embodiment, the conveyance passage 16 is disposed on a right inside the body 100 to convey a recording medium P perpendicularly upward to the internal discharge unit 18 provided between the body 100 and the image scanner 200.

A pair of conveyance rollers 19 to convey the recording medium P, a secondary transfer device 21 facing the intermediate transfer belt 11, the fixing device 60, and the discharge device 23 are provided, in that order, along the conveyance passage 16 in a direction in which the recording medium P is conveyed therethrough. There is further provided a branch conveyance passage, herein called a re-feed conveyance passage 24, located downstream from the fixing device 60 in the direction in which the recording medium P is conveyed. The re-feed conveyance passage 24 feeds the recording medium P back to the duplex unit 300.

In the present embodiment, the feed rollers 17 are positioned above and to the right of the trays 15, respectively, as illustrated in FIG. 1. The feed rollers 17 pick up the recording media P one by one from the trays 15 and feed them to the conveyance passage 16.

The internal discharge unit 18 is provided between the body 100 and the image scanner 200 to accept the recording media P discharged from the discharge device 23.

The primary transfer devices 25C, 25M, 25Y, and 25K contact the respective image carriers of the imaging devices 12C, 12M, 12Y, and 12K via the intermediate transfer belt 11. The primary transfer devices 25C, 25M, 25Y, and 25K primarily transfer toner images from the respective image carriers of the imaging devices 12C, 12M, 12Y, and 12K onto the intermediate transfer belt 11 sequentially to form a desired color image thereon.

The optical sensor 50 is provided downstream from the pair of conveyance rollers 19 in the direction in which the recording medium P is conveyed. The optical sensor 50 calculates the smoothness of the recording medium P conveyed along the conveyance passage 16 from one of the trays 15 or a bypass tray 36. This location of the optical sensor 50 obviates the need to provide an optical sensor for each of the trays 15 and the bypass tray 36, and allows a single optical sensor to calculate the smoothness of all the recording media P conveyed along the conveyance passage 16. A detailed description of the optical sensor 50 is deferred.

A feed passage 37 is provided upstream from the pair of conveyance rollers 19 in the direction in which the recording medium P is conveyed. The feed passage 37 joins the conveyance passage 16 to feed the recording medium P carrying a fixed image from the duplex unit 300 to the conveyance passage 16 again, or to feed a recording medium P coming from the bypass tray 36 through the duplex unit 300.

The secondary transfer device 21 transfers the color toner image from the intermediate transfer belt 11 onto the recording medium P at a secondary transfer position between the intermediate transfer belt 11 and the secondary transfer device 21.

The fixing device 60 includes a heating member to heat the recording medium P and a pressing member to apply pressure to the recording medium P. The fixing device 60 fixes an unfixed toner image onto the recording medium P under heat and pressure between the heating member and the pressing member.

A description is now given of image forming operation performed in the image forming apparatus 1 for photocopying an original.

Firstly, in the image forming apparatus 1, the charging devices uniformly charge the respective image carriers of the imaging devices 12C, 12M, 12Y, and 12K. Then, the exposure device 13 irradiates the charged image carriers of the imaging devices 12C, 12M, 12Y, and 12K to form latent images thereon according to image data of the respective colors of an original scanned by the image scanner 200.

Thereafter, the development devices develop the latent images formed on the image carriers of the imaging devices 12C, 12M, 12Y, and 12K with toner of the respective colors into toner images.

Then, the primary transfer devices 25C, 25M, 25Y, and 25K primarily transfer the toner images from the image carriers of the imaging devices 12C, 12M, 12Y, and 12K, respectively, onto the intermediate transfer belt 11 sequentially to form a desired color image thereon.

In the meantime, one of the feed rollers 17 is selectively rotated to pick up a recording medium P from the corresponding one of the vertically disposed trays 15. Alternatively, a recording medium P is sent from the bypass tray 36 to the feed passage 37.

The recording medium P fed from the one of the trays 15 or fed from the bypass tray 36 and passing through the feed passage 37 is then conveyed along the conveyance passage 16 to the pair of conveyance rollers 19.

The pair of conveyance rollers 19 sends the recording medium P to the secondary transfer position between the intermediate transfer belt 11 and the secondary transfer device 21 in synchronization with the movement of the intermediate transfer belt 11 carrying the color toner image.

Before the recording medium P reaches the secondary transfer position, the optical sensor 50 calculates the smoothness of the recording medium P conveyed from the pair of conveyance rollers 19. At the secondary transfer position, the secondary transfer device 21 transfers the color toner image from the intermediate transfer belt 11 to the recording medium P.

The recording medium P carrying the color toner image is then conveyed to the fixing device 60. The fixing device 60 fixes the color toner image onto the recording medium P by applying heat and pressure to the recording medium P between the heating member and the pressing member.

Upon duplex printing, the recording medium P carrying the color image fixed on a front surface thereof is sent to the re-feed conveyance passage 24 via a pawl that switches the conveyance passage. The recording medium P is conveyed to the duplex unit 300 along the re-feed conveyance passage 24 to form another image on a back surface thereof.

The recording medium P is turned over from one side to the other while passing through the duplex unit 300, and reaches the conveyance passage 16 through the feed passage 37.

The secondary transfer device 21 secondarily transfers another color toner image from the intermediate transfer belt 11 onto the back surface of the recording medium P conveyed along the conveyance passage 16 in the same manner as the other color toner image is transferred onto the front surface thereof. Thereafter, the recording medium P is conveyed to the fixing device 60, which fixes the color image onto the back surface of the recording medium P.

After the color toner image(s) is/are completely fixed onto the recording medium P, the discharge device 23 discharges the recording medium P carrying the fixed color toner image (s) onto the internal discharge unit 18 that accepts the recording media P. Thus, the image forming apparatus 1 completes the image forming operation.

Figure 2:
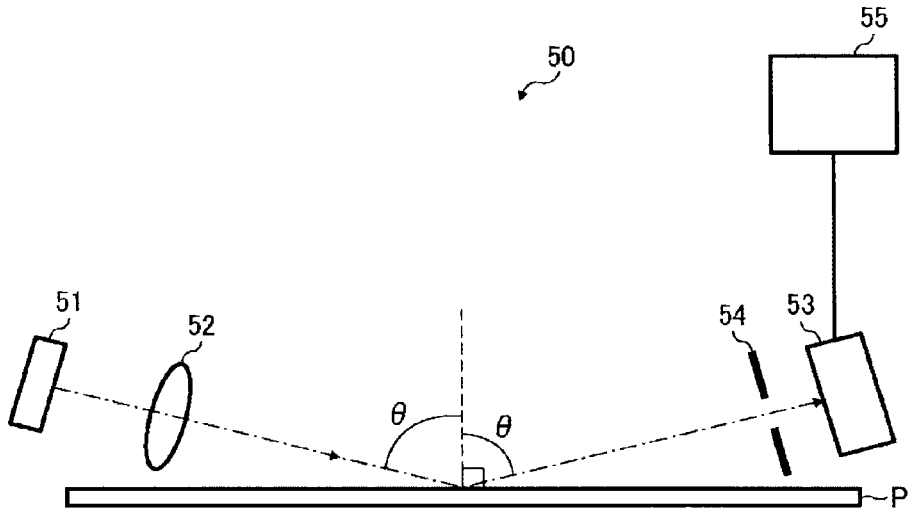
FIG. 2 is a schematic view of an optical sensor incorporated in the image forming apparatus of FIG. 1.

Referring now to FIG. 2, a detailed description is given of the optical sensor 50 incorporated in the image forming apparatus 1 described above.

FIG. 2 is a schematic view of the optical sensor 50. The optical sensor 50 includes a light source 51, a collimator lens 52, a specular-reflection light sensor 53, an aperture 54, and a processor 55. Alternatively, the processor 55 may be disposed outside the optical sensor 50 in the image forming apparatus 1. For example, the processor 55 may be a part of central processing unit (CPU) 101.

The light source 51 of the present embodiment is constructed of vertical cavity surface emitting lasers (VCSELs) to suppress a far-field pattern (FFP) more effectively than typical stable light sources such as light emitting diodes (LEDs) or edge laser diodes (LDs), thereby forming a more accurate optical system. Here, the FFP refers to the beam divergence of a laser beam. Alternatively, the light source 51 may be constructed of, e.g., LEDs.

The collimator lens 52 is a convex lens provided between the light source 51 and a reflective surface of the recording medium P to turn light beams emitted by the light source 51 into collimated light. Specifically, the collimator lens 52 turns diffusing or converging light beams emitted by the light source 51 into parallel light beams, that is, collimated light.

In addition, the collimator lens 52 adjusts the parallelism of collimated light and the angle of incidence of a light beam emitted by the light source 51 and hitting the reflective surface of the recording medium P. With the collimator lens 52, the optical sensor 50 can enhance its sensitivity of detecting the smoothness of the recording medium P.

The specular-reflection light sensor 53 is provided downstream from the reflective surface of the recording medium P in a direction in which the light beams travel from the light source 51. The specular-reflection light sensor 53 is constructed of, e.g., photodiodes to detect light specularly reflected from the recording medium P.

Specifically, the specular-reflection light sensor 53 detects an amount of reflected light, that is, the strength of light specularly reflected from the recording medium P, as a voltage, and outputs detected data to the processor 55 as an output signal that the processor 55 can use to calculate the smoothness of the recording medium P.

The aperture 54 is provided between the reflective surface of the recording medium P and the specular-reflection light sensor 53 to limit the angle of incidence of the light beams reflected from the recording medium P and entering the specular-reflection light sensor 53. With the aperture 54, the optical sensor 50 can ensure that a sufficient number of the light beams are emitted by the light source 51 and reflected from the reflective surface of the recording medium P and can limit scattering light beams among the reflected light beams, thereby preventing decrease in smoothness detection accuracy.

The processor 55 is connected to the specular-reflection light sensor 53 and calculates the smoothness of the recording medium P according to the voltage detected by the specular-reflection light sensor 53. A detailed description of a function of the processor 55 is deferred.

Figure 3:
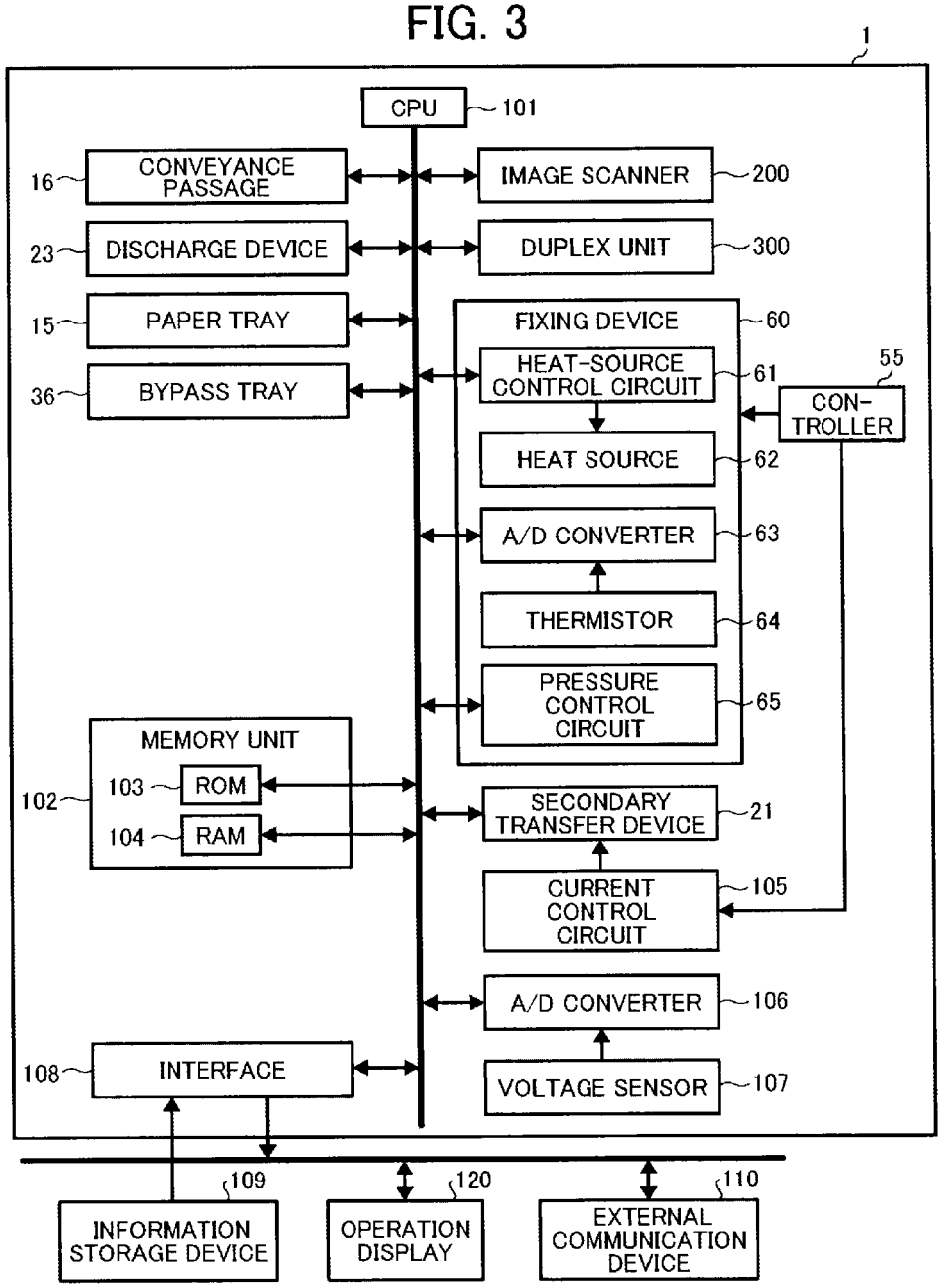
FIG. 3 is a functional block diagram of the image forming apparatus of FIG. 1.

FIG. 3 is a functional block diagram of the image forming apparatus 1.

In FIG. 3, the CPU 101 is connected to other components of the image forming apparatus 1 via a bus to control the components so that the image forming apparatus 1 works properly.

Specifically, the CPU 101 is connected to the trays 15, the conveyance passage 16, the secondary transfer device 21, the discharge device 23, the bypass tray 36, the fixing device 60, a memory unit 102, an analog-to-digital (A/D) converter 106, a voltage sensor 107, and an interface 108. The CPU 101 is also connected to the image scanner 200 and the duplex unit 300.

The fixing device 60 includes a heat-source control circuit 61 and a heat source 62, and a thermistor to detect temperatures of the heating member and the pressing member. The heat-source control circuit 61 serves as a temperature adjuster to adjust a fixing temperature by controlling an amount of heat to supply, that is, an amount of heat that the heat source 62 supplies for the heating member.

The fixing device 60 further includes an A/D converter 63 that converts an analog value detected by the thermistor 64 into a digital value and notifies the CPU 101 of the digital value for processing by the CPU 101. The fixing device 60 further includes a pressure control circuit 65 to control a force for pressing the pressing member against the heating member and a distance between the heating member and the pressing member.

The memory unit 102 includes a read only memory (ROM) 103 and a random access memory (RAM) 104. The ROM 103 stores a fixing control pattern and a program code that the CPU 101 executes. The RAM 104 temporarily stores detected voltage.

The CPU 101 reads the program code from the ROM 103 and executes a program defined by the program code using the RAM 104 as a data buffer to control the components of the image forming apparatus 1.

The fixing device 60 is connected to the processor 55 of the optical sensor 50 to receive a signal transmitted by the processor 55, with which the control of the heat-source control circuit 61 and the pressure control circuit 65 is executed.

A current control circuit 105 receives a signal transmitted by the processor 55 of the optical sensor 50 to control a transfer current with which the secondary transfer device 21 transfers the toner image onto the recording medium P.

The A/D converter 106 converts an analog voltage detected by the voltage sensor 107, which detects voltage so that control is executed in a stable power state, into a digital value and notifies the CPU 101 of the digital value for processing by the CPU 101.

The interface 108 serves as a connector to connect the image forming apparatus 1 with external devices such as an information storage device 109 and an external communication device 110 to take image data into the image forming apparatus 1 from outside. The information storage device 109 is, e.g., a hard disk drive and the external communication device 110 is, e.g., a personal computer.

An operation display 120 serving as a display device is disposed at a predetermined position of the body 100 illustrated in FIG. 1 to display messages including an error message, while serving as an operation panel to accept instruction input.

In image forming apparatuses, fixing conditions including a heat amount and a pressing force are taken into account to appropriately fix the toner image onto the recording medium. Particularly, fixing conditions are determined for each type of recording medium to form a high-quality image on the recording medium because the image quality is significantly influenced by, e.g., the material, thickness, humidity, smoothness, and coating conditions of the recording medium. The smoothness can be indicated by, e.g., time (in seconds) taken for a certain amount of air to flow between a surface of a sheet and a testing board adhering to each other. It is to be noted that "coating" means coating or printing the recording medium with, e.g., ink or paint.

The smoothness and fixing quality of the recording medium are correlated because the fixing rate of toner in recessed portions of the recording medium depends on the roughness thereof. Accordingly, if an image is fixed onto the recording medium neglecting the smoothness, a high-quality image may not be obtained and, in some cases, fixing errors may occur, generating an unusual image on the recording medium.

Meanwhile, with recent progress in the image forming apparatuses as well as diversified expression, there are hundreds of different types of recording sheets (e.g., recording media). Each type of recording sheets has a variety of brands with, e.g., different basis weight and thickness. Therefore, to form a high-quality image, fixing conditions are determined in detail according to, e.g., the types and brands of recording media.

For example, the types of recording media includes, e.g., plain paper, coated paper such as gross coated paper, mat coated paper, and art coated paper, overhead projector (OHP) sheets, and special paper such as a sheet of paper prepared by embossing a surface thereof. Increasing numbers of such special paper have come into recent usage. It is to be noted that there exist recording media other than recording sheets.

In the image forming apparatuses, generally, the fixing conditions are determined according to the basis weight of the recording material, by which the recording material is classified. For example, paper having a basis weight of about 60 $g/m^2$ to about 90 $g/m^2$ is classified as plain paper. Paper having a basis weight of about 91 $g/m^2$ to about 105 $g/m^2$ is classified as medium thick paper. Paper having a basis weight of about 106 $g/m^2$ to about 200 $g/m^2$ is classified as thick paper. Fixing temperatures and conveying speeds of recording media are determined according to these classifications.

Generally, the basis weight of recording material is listed on a package of recording media so that users easily know the basis weight information. The basis weight information is selected through an operation panel of a copier or on a printer driver displayed on a printer, thus acknowledged. Generally, the users set the basis weight information by themselves, which may be troublesome for them upon printing. In addition, if the users erroneously set the basis weight information, an intended high-quality image may not be obtained. Accordingly, some image forming apparatuses incorporate a sensor to detect, e.g., the thickness of recording media to automatically sort the recording medium to form images thereon.

On the other hand, the smoothness of recording media is not usually listed on the package of recording material, which makes it difficult for the users to know the smoothness information. For this reason, the users may use, e.g., a sensor to obtain the smoothness of recording media.

As described above, the smoothness and fixability are correlated. However, it is difficult to detect the smoothness in a short period of time because the smoothness represents the time taken for a certain amount of air to flow between a recording material and a testing board. Accordingly, sensors may be used to measure surface roughness or an amount of reflected light as alternative characteristics to the smoothness because such surface roughness or an amount of reflected light and the smoothness are correlated.

For example, the smoothness of a recording medium is detected according to an amount of light reflected from a surface of the recording medium when the recording medium is irradiated with light emitted from a light source such as a light-emitting diode (LED). In this detecting system, the smoothness can be detected without contacting the recording medium, and therefore, without damaging the recording medium.

More specifically, for example, an amount of light specularly reflected from the surface of the recording medium is detected among the light reflected from the surface of the recording medium to detect the smoothness of the recording medium.

Alternatively, image forming apparatuses may include a plurality of light amount detectors to detect an amount of scattered light in addition to the amount of light specularly reflected from the surface of the recording medium to identify the smoothness of the recording medium.

When changing the fixing conditions according to the smoothness, generally, a sensor detects the smoothness and then the fixing conditions (e.g., fixing temperature) are adjusted according to the detected smoothness. For example, the image forming apparatuses ensure their fixing quality by increasing the fixing temperature when an image is fixed onto a recording medium having a relatively low smoothness, that is, when it is relatively hard to fix the image onto the recording medium. By contrast, the image forming apparatuses enhance energy efficiency by decreasing their fixing temperature when an image is fixed onto a recording medium having a relatively high smoothness, that is, when it is relatively easy to fix the image onto the recording medium.

However, compact image forming apparatuses typically have a configuration in which there is little space with only a relatively short distance between the sensor that detects the smoothness of recording media and the fixing device, and therefore, have difficulty in securing enough time to adjust the fixing temperature according to the smoothness detected by the sensor before the recording media reach the fixing device. For example, if recording media having relatively low smoothness (i.e., fixing strength) and those having relatively high smoothness (i.e., fixing strength) are both being used, the fixing temperature cannot be adjusted for each recording medium, causing fixing failures.

According to the present embodiment, the image forming apparatus 1 performs control according to the smoothness of recording media to prevent fixing failures, as described below.

Figure 4:
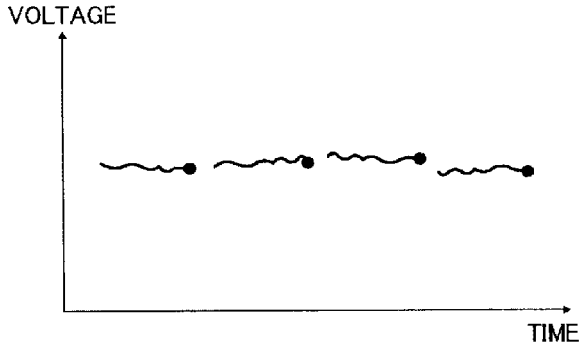
FIG. 4 is a graph illustrating the smoothness of a recording medium according to an embodiment of this disclosure.

FIG. 4 illustrates an amount of reflected light for each recording medium P, that is, the strength of light specularly reflected from each recording medium P, detected as a voltage wave by the optical sensor 50, to measure the smoothness of the recording media P conveyed from the trays 15 one by one.

The optical sensor 50 detects an amount of light specularly reflected from each recording medium P with the specular-reflection light sensor 53 as a voltage. In FIG. 4, each solid line indicates transition of detected amount of reflected light for each recording medium P, while each dot indicates an average calculated according to the detected amount of reflected light for each recording medium P.

As illustrated in FIG. 4, the smoothness is not exactly the same but tends to be substantially the same when the recording media P are of the same brand. For example, the same brand of 20 recording media had a variation in smoothness of about 8% at most from an average smoothness in an examination of variation in smoothness of over 100 brands of recording media selected at random.

Figure 5:
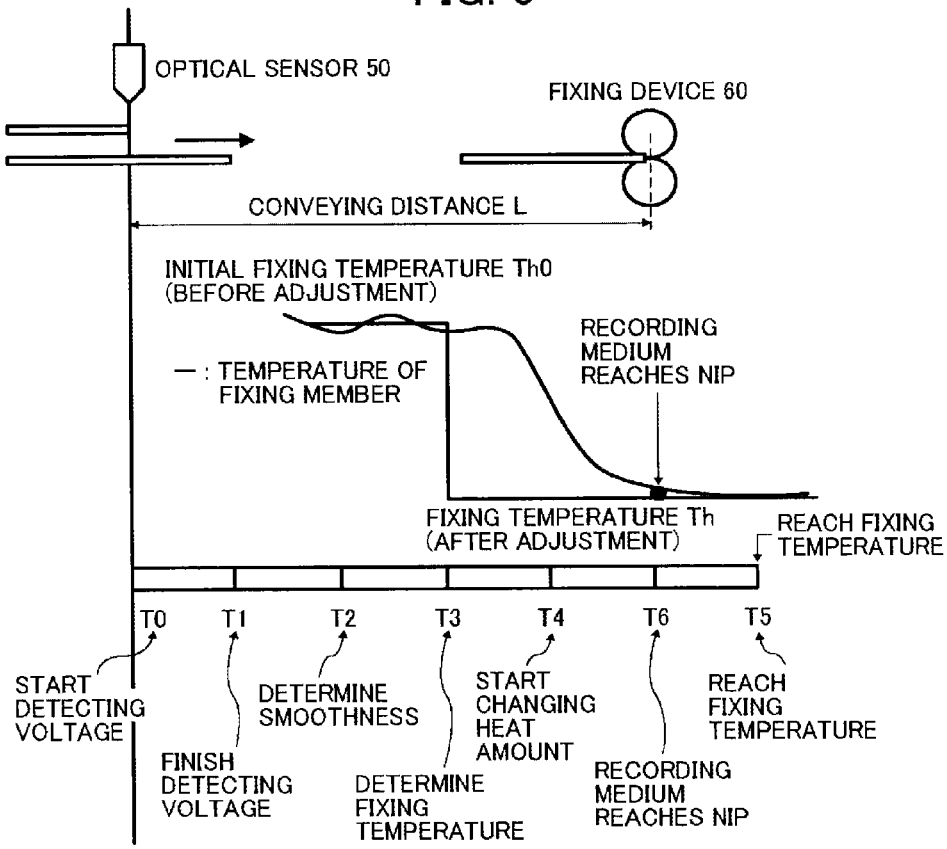
FIG. 5 is a time chart illustrating a fixing process executed by a fixing device incorporated in the image forming apparatus of FIG. 1.

FIG. 5 is a timing chart illustrating a fixing process of the fixing device 60.

The optical sensor 50 calculates the smoothness of the recording medium P. According to the calculated smoothness, the fixing device 60 adjusts each parameter value included in a predetermined parameter group used for fixing an image onto the recording medium P.

Firstly, the optical sensor 50 starts detecting the smoothness of the recording medium P at a time T0 when the optical sensor 50 faces a leading end of the recording medium P.

The optical sensor 50 detects the recording medium P conveyed at a conveying speed V from the time T0 until a time T1. In this processing, the optical sensor 50 irradiates an imaged surface of the recording medium P with laser light emitted by the light source 51 via the collimator lens 52 until the time T1. The laser light specularly reflected from the imaged surface of the recording medium P passes through the aperture 54 and enters the specular-reflection light sensor 53. It is to be noted that the time T1 is a sufficient time for the optical sensor 50 to complete calculation started at the time T0 of the smoothness of the recording medium P conveyed at the conveying speed V.

At a time T2, the optical sensor 50 determines the smoothness of the recording medium P with the processor 55, using voltage detected until the time T1. It is to be noted that the time T2 is a sufficient time for the processor 55 of the optical sensor 50 to determine the smoothness of the recording medium P, using the voltage measured by the optical sensor 50 until the time T1.

At a time T3, the optical sensor 50 determines a fixing temperature Th of the fixing device 60 according to the smoothness thus determined and an amount of heat to supply that achieves the fixing temperature Th. The optical sensor 50 then transmits the amount of heat to supply from the processor 55 to the heat-source control circuit 61 of the fixing device 60.

Then, the fixing device 60 adjusts the amount of heat to supply from one that maintains an initial fixing temperature Th0 as a predetermined temperature to one that achieves the fixing temperature Th, thereby adjusting the fixing temperature between the heating member and the pressing member.

It is to be noted that the initial fixing temperature Th0 is a fixing temperature at which an image is appropriately fixed on a recording medium P having a typical smoothness of, e.g., 40 seconds, but not limited thereto.

When a recording medium has a relatively high smoothness, fixing failures may not occur even at a relatively low fixing temperature. Accordingly, if the smoothness of the recording medium P is relatively high, the optical sensor 50 transmits a smaller amount of heat to supply than the amount of heat to supply that maintains the initial fixing temperature Th0 from the processor 55 to the heat-source control circuit 61.

By contrast, when a recording medium has a relatively low smoothness, fixing failures may occur unless the fixing temperature is relatively high. Accordingly, if the smoothness of the recording medium P is relatively low, the optical sensor 50 transmits a larger amount of heat to supply than the amount of heat to supply that maintains the initial fixing temperature Th0 from the processor 55 to the heat-source control circuit 61.

Thus, the fixing device 60 adjusts the fixing temperature to be the fixing temperature Th as an optimum fixing temperature according to the smoothness of the recording medium P. Accordingly, image fixing failures can be prevented while an image can be fixed onto the recording medium P with a minimum energy, thereby enhancing energy efficiency.

At a time T4, the fixing device 60 adjusts the amount of heat to supply, that is, the amount of heat that the heat source 62 supplies for the heating member, according to the amount of heat to supply determined at the time T3. At a time T5, the fixing temperature between the heating member and the pressing member reaches the fixing temperature Th.

In the meantime, the recording medium P is conveyed at the conveying speed V from the time T0 when the leading end thereof faces the optical sensor 50 until a time T6 when the recording medium P reaches the fixing device 60. The time T6 is T0+L/V, where V represents the conveying speed and L represents a conveying distance between the position where the leading end of the recording medium P faces the optical sensor 50 and the fixing device 60.

As illustrated in FIG. 5, the time T6 may be earlier than the time T5 due to time constraints, for example, when it takes time for the fixing device 60 to adjust the fixing temperature, the conveying distance L is relatively short, or the conveying speed V is relatively high. In such a case, the fixing device 60 has difficulty in adjusting the fixing temperature for each recording medium P.

Accordingly, the processor 55 determines a fixing temperature taking into account the variation in smoothness of the recording media P. For example, the processor 55 may determine a fixing temperature provided with a certain margin of safety.

Specifically, the processor 55 calculates an average smoothness of the recording media P to determine a fixing temperature that does not cause fixing failures even on a recording medium P having a smoothness differing from the calculated average smoothness by less than about 8%.

Thus, according to the present embodiment, a threshold error is about 8% of the average smoothness. Alternatively, the threshold error may be equal to or higher than about 8% to prioritize the productivity, or may be less than about 8% to prevent fixing failures.

If a detected smoothness differs from the average smoothness by about 8% or higher, the processor 55 identifies a malfunction, for example, the smoothness is not properly detected due to conveyance errors, disturbing adjustment of fixing temperature according to the smoothness of the recording medium P.

Thus, the processor 55 compares a smoothness of recording medium P currently detected and an average smoothness of recording media P previously detected to determine whether an image can be appropriately fixed onto the recording medium P. According to the present embodiment, the processor 55 serves as a smoothness comparer.

If the processor 55 identifies a malfunction, the CPU 101 stops conveying the recording medium P from the optical sensor 50 to the fixing device 60 because it is determined that an image cannot be appropriately formed on the recording medium P.

Accordingly, the image forming apparatus 1 can prevent fixing failures when an image cannot be appropriately formed on the recording medium P due to the malfunction that disturbs adjustment of fixing temperature according to the smoothness of the recording medium P.

According to the present embodiment, the conveyance passage 16, the feed rollers 17, the pair of conveyance rollers 19, the feed passage 37, and the CPU 101 constitute a conveyor.

As described above, the image forming apparatus 1 of the present embodiment forms an image on each of the recording media P. The image forming apparatus 1 includes the optical sensor 50 to irradiate each of the recording media P with light to detect smoothness of each of the recording media P according to an amount of specularly reflected light of the light with which each of the recording media P is irradiated.

The image forming apparatus 1 further includes the processor 55 to compare the smoothness of the recording media P to determine whether a normal image can be formed on one of the recording media P having a smoothness detected last.

Accordingly, the image forming apparatus 1 can determine whether a normal image can be formed on the one of the recording media P according to changes in the smoothness of the recording media P detected continuously, thereby preventing fixing failures.

In the image forming apparatus 1 of the present embodiment, the processor 55 determines that a normal image cannot be formed on the one of the recording media P if the one of the recording media P having a smoothness differing by about 8% or higher from an average in smoothness of others of the recording media P detected before the one of the recording media P is detected.

Accordingly, the image forming apparatus 1 can determine that a normal image cannot be formed on the one of the recording media P due to the malfunction that disturbs adjustment of fixing temperature according to the smoothness of the recording media P, thereby preventing fixing failures.

The image forming apparatus 1 of the present embodiment further includes the conveyance passage 16, the feed rollers 17, the pair of conveyance rollers 19, the feed passage 37, and the CPU 101 that stop conveying the recording media P if the processor 55 determines that a normal image cannot be formed on the one of the recording media P.

Accordingly, the image forming apparatus 1 can prevent fixing failures by stopping conveying the recording media P if the processor 55 determines that a normal image cannot be formed on the one of the recording media P.

According to the present embodiment, the processor 55 determines that a normal image cannot be formed on the one of the recording media P if the one of the recording media P having a smoothness differing by about 8% or higher from the average in smoothness of others of the recording media P detected before the one of the recording media P is detected.

Alternatively, however, the processor 55 may determine that a normal image cannot be formed on the one of the recording media P if the smoothness continuously detected increases or decreases monotonically.

Generally, the smoothness of the same brand of recording media P varies substantially at random. Therefore, if the smoothness monotonically increases or decreases, a malfunction is deemed to have occurred, disturbing adjustment of fixing temperature according to the smoothness of the recording media P.

Accordingly, the image forming apparatus 1 can determine that a normal image cannot be formed on the recording medium P on detecting the malfunction that monotonically increases or decreases the smoothness of the recording media P, thereby preventing fixing failures.

According to the present embodiment, the image forming apparatus 1 stops conveying the recording media P if it is determined that a normal image cannot be formed on the one of the recording media P. Alternatively, however, the image forming apparatus 1 may adjust the fixing temperature to be the initial fixing temperature Th0 to fix a toner image on the one of the recording media P.

Accordingly, the image forming apparatus 1 can enhance productivity as the image forming apparatus 1 fixes the toner image on the one of the recording media P at a fixing temperature that reduces risks of fixing failures, instead of stopping fixing operation, if the processor 55 determines that a normal image cannot be formed on the one of the recording media P.

According to the present embodiment, the image forming apparatus 1 stops conveying the recording media P by internal processing if the processor 55 determines that a normal image cannot be formed on the one of the recording media P. Alternatively, however, the image forming apparatus 1 may display with the operation display 120 a warning or error message indicating a malfunction.

Accordingly, the image forming apparatus 1 can inform a user of the malfunction if the processor 55 determines that a normal image cannot be formed on the one of the recording media P due to the malfunction, allowing the user to promptly notice the malfunction.

According to the present embodiment, the optical sensor 50 determines an average in voltage detected by the specular-reflection light sensor 53 from the time T0 to the time T1 as the smoothness of each recording medium P. Alternatively, however, a minimum detected voltage may be determined as the smoothness of each recording medium P.

According to the present embodiment, the optical sensor 50 is disposed to detect a surface of each recording medium P onto which a toner image is fixed. Alternatively, however, the optical sensor 50 may be disposed to detect the other surface of each recording medium P for convenience of arrangement in the image forming apparatus 1.

According to the present embodiment, the fixing device 60 determines the amount of heat to supply, according to the smoothness detected by the optical sensor 50. Alternatively, however, a correlation between smoothness of recording media P and fixing temperatures may be obtained beforehand by, e.g., experiments, and a relation between voltages and fixing temperatures is tabulated and stored in the processor 55 to determine the amount of heat to supply. Alternatively, an equation made by experimental values may be stored in the processor 55 to obtain the amount of heat to supply, according to a detected smoothness.

This disclosure references specific embodiments. It is to be noted that this disclosure is not limited to the details of the embodiments described above, but various modifications and enhancements are possible without departing from the scope of the invention. It is therefore to be understood that this disclosure may be practiced otherwise than as specifically described herein. For example, elements and/or features of different illustrative embodiments may be combined with each other and/or substituted for each other within the scope of the present invention.

What is claimed is:

1. An image forming apparatus for forming an image on each of recording media, the image forming apparatus comprising:

an optical sensor to irradiate each of the recording media with light to detect smoothness of each of the recording media according to a strength of specularly reflected light of the light with which each of the recording media is irradiated; and a processor to compare a smoothness of one of the recording media and an average in smoothness of a remaining of the recording media detected before the smoothness of the one of the recording media is detected, and to determine whether a normal image can be formed on the one of the recording media based on the comparison.

2. The image forming apparatus according to claim 1, wherein the processor determines that the normal image cannot be formed on the one of the recording media if the one of the recording media has a smoothness differing by a predetermined value or greater from the average in smoothness of the remaining of the recording media detected before the smoothness of the one of the recording media is detected.

3. The image forming apparatus according to claim 1, wherein the processor determines that the normal image cannot be formed on the one of the recording media if the smoothness of the recording media continuously detected increases or decreases monotonically.

4. The image forming apparatus according to claim 1, further comprising a conveyor, wherein the conveyor stops conveying the recording media if the processor determines that the normal image cannot be formed on the one of the recording media.

5. The image forming apparatus according to claim 1, further comprising a temperature adjuster to adjust a fixing temperature according to the smoothness of the recording media detected by the optical sensor, wherein the temperature adjuster adjusts the fixing temperature to a predetermined temperature if the processor determines that the normal image cannot be formed on the one of the recording media.

6. The image forming apparatus according to claim 1, further comprising a display device to display a warning if the processor determines that the normal image cannot be formed on the one of the recording media.

7. An image forming apparatus for forming an image on each of recording media, the image forming apparatus comprising:

an optical sensor to irradiate each of the recording media with light to detect smoothness of each of the recording media according to a strength of specularly reflected light of the light with which each of the recording media is irradiated; and a processor to compare the smoothness of the recording media to determine whether a normal image can be formed on one of the recording media having a smoothness detected last, wherein the processor determines that the normal image cannot be formed on the one of the recording media if the smoothness of the recording media continuously detected increases or decreases monotonically.

* * * * *